US005263089A

United States Patent [19]

Ribic

[11] Patent Number: 5,263,089

[45] Date of Patent: Nov. 16, 1993

[54] HEARING AID

[75] Inventor: Zlatan Ribic, Vienna, Austria

[73] Assignee: Viennatone Gesellschaft m.b.H., Vienna, Austria

[21] Appl. No.: 781,769

[22] Filed: Oct. 23, 1991

[30] Foreign Application Priority Data

Nov. 7, 1990 [AT] Austria ..... 2237/90

[51] Int. Cl.[5] ..... H04R 25/00

[52] U.S. Cl. ..... 381/68.2; 381/68.4; 328/127

[58] Field of Search ..... 381/68, 68.2, 68.4; 307/520; 328/167, 127, 128

[56] References Cited

U.S. PATENT DOCUMENTS 3,619,659 11/1971 Meyer ..... 328/127
4,453,132 6/1984 Stamler ..... 330/100

FOREIGN PATENT DOCUMENTS 1294456 8/1966 Fed. Rep. of Germany ..... 328/128
2192511 1/1988 United Kingdom ..... 381/68

OTHER PUBLICATIONS

"The Miller Integrator", B. H. Briggs, Electronic Engineering, pp. 243-247, Aug. 1948.

*Primary Examiner*—Jin F. Ng
*Assistant Examiner*—Huyen D. Le
*Attorney, Agent, or Firm*—Collard & Roe

[57] ABSTRACT

A hearing aid with a microphone, with at least one amplifier fed with the signals from said microphone, whereby the amplifier cooperates with a filter of a higher order for influencing the frequency response, and with a loudspeaker which transforms the amplified signals into soundwaves. This filter (3) can be arranged in the conventional manner between two amplification stages or in the feedback loop of the amplifier (6). In order to allow the optimal adjustment of the frequency response to the respective requirements it is provided in this hearing aid that the filter (3) is arranged as a multiple filter with a biquadratic structure and comprises at least two integrators and an inverting amplifier, whereby the active elements of their components are formed by transistors, preferably single transistors (T1, T2, T3). The feedback loop of the amplifier (6) is guided through an adjustable potentiometer ($R_A$) for setting the filter emphasis or de-emphasis and in the filter circuit (3) there is arranged an adjustable potentiometer ($R_F$) for setting the mid-frequency of the filter (3).

3 Claims, 4 Drawing Sheets

HEARING AID

BACKGROUND OF THE INVENTION

The invention relates to a hearing aid with a microphone, at least one amplifier fed with the signal from said microphone, whereby said amplifier cooperates with a filter of a higher order which is arranged as a multiple filter for influencing the frequency response, and a loudspeaker which transforms the amplified signals into soundwaves.

In order to adjust a hearing aid to the user's requirements it is necessary to suitably select and set the frequency response of the device. For this purpose it is known to use highpass and/or lowpass filters, which more or less influence the frequency response. Sometimes also bandpass filters are used which are arranged by a highpass and a lowpass filter. A case is known in which a "graphic equalizer" is used, a parallel circuit of several bandpass filters with predetermined frequency bands, but with independently controllable amplitudes. Filters of a higher order, however, which enable a good adjustment to the frequency response require a relatively large amount of components.

Research has shown that for achieving frequency response curves that are desirable for practical operation it is sufficient to combine one of the known highpass and/or lowpass filters with a band equalizer, which allows either emphasizing or de-emphasizing any selectable mid-frequency. Parametric filters are suitable for such a band equilizer, whereby such filters, designed with operational amplifiers, have long been used in studio engineering. However, such parametric filters required a high amount of circuitry and therefore could not be used in former designs due to the lack of available space and the low operating voltage that is used in the technology of hearing aids.

SUMMARY OF THE INVENTION

It is the object of the present invention to propose a hearing aid of the type mentioned above, which allows the optimal adjustment of the frequency response.

In accordance with the invention this is achieved in that the filter comprises a biquadratic structure and at least two integrators and one inverting amplifier, whereby the active elements among their components are formed by discrete components, in particular single transistors.

This measure gives the advantage that two or three parameters can be controlled in a very simple manner. Thus, for example, the mid-frequency, the filter quality or the amplitude of the emphasis or the de-emphasis, and also the type of filter, for example lowpass, highpass or bandpass, can be selected in accordance with the arrangement of the filter output.

Multiple filters with biquadratic structure are known in the literature, for example from "RC Active Filter Desing Handbook", J. Wiley & Sons, 1985. However, these filters are always designed with operational amplifiers. Such a filter design, however, is not suitable for use in hearing aids, as it is not possible due to limitations in the available space to build in, in addition to the usual amplifier components, the components that are necessary for the filter and the three operational amplifiers that were necessary until now. Furthermore, the power supply consisting of a 1.4 V battery which has an average operating voltage of 1.2–1.3 V and which is usually provided for hearing aids is usually not sufficient for operating operational amplifiers. There is not enough space in a hearing aid for a power source with a higher voltage (exception: a box-type device).

The proposed solution avoids these problems, whereby despite the use of single transistors and low integrated components a kind of biquad filter comes about with which, as was mentioned above, several parameters can be set very simply and with which the frequency response of the hearing aid can be adjusted to the desired frequency response to a large extent.

Furthermore, it can be provided in a hearing aid with an amplifier comprising a feedback loop that the filter is arranged in the feedback loop of the amplifier. In this manner it is possible to selectively influence only one frequency range and to arrange an equalizer circuit for a hearing aid.

In accordance with a further feature of the invention it can be provided that the individual stages of the filters are connected to one another by one or several feedback loops.

In connection with this measure it is possible to achieve a particularly good adjustment of the frequency response of the hearing aid by building in adjustable components into the feedback lines.

It may further be provided that the feedback loop of the amplifier is directed through a potentiometer for setting the filter emphasis or de-emphasis and that a potentiometer is arranged in the filter circuit for setting the mid-frequency of the filter.

These measures lead to a simple arrangement, which nevertheless ensure a far-reaching adjustment of the hearing aid to the desired frequency response curve.

BRIEF DESCRIPTION OF THE DRAWINGS

The invention is now outlined in greater detail by reference to the enclosed drawings, in which.

DETAILED DESCRIPTION OF THE PREFERRED EMBODIMENT

Figure 1:
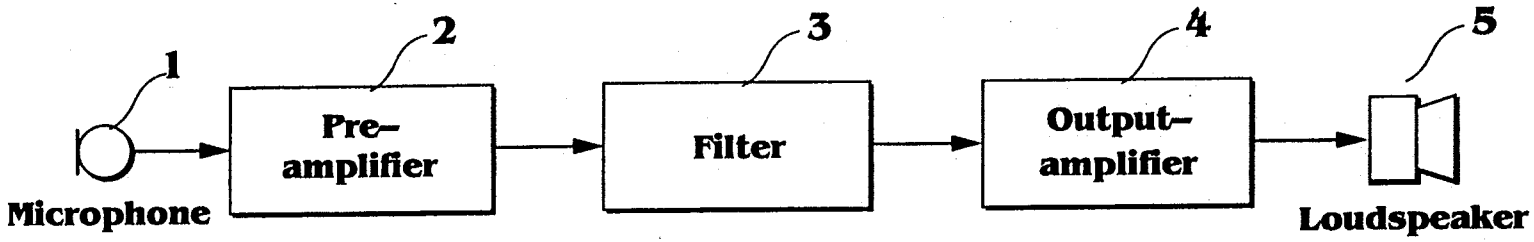
FIG. 1 shows a circuit diagram of a hearing aid in accordance with the invention, whereby the filter is arranged between two amplifier stages.

FIG. 1 shows a circuit diagram of a hearing aid in accordance with the invention, whereby the microphone 1 transforms a sound signal into an electrical signal which is amplified in the preamplifier 2. Said signal then passes filter 3 for undergoing modulation of the frequency response and finally, after having been amplified to the desired output level by output amplifier 4, it is again transformed into an acoustic sound signal by loudspeaker 5. In this variation of the circuit the filter is arranged in a conventional manner between two amplifier stages.

Figure 2:
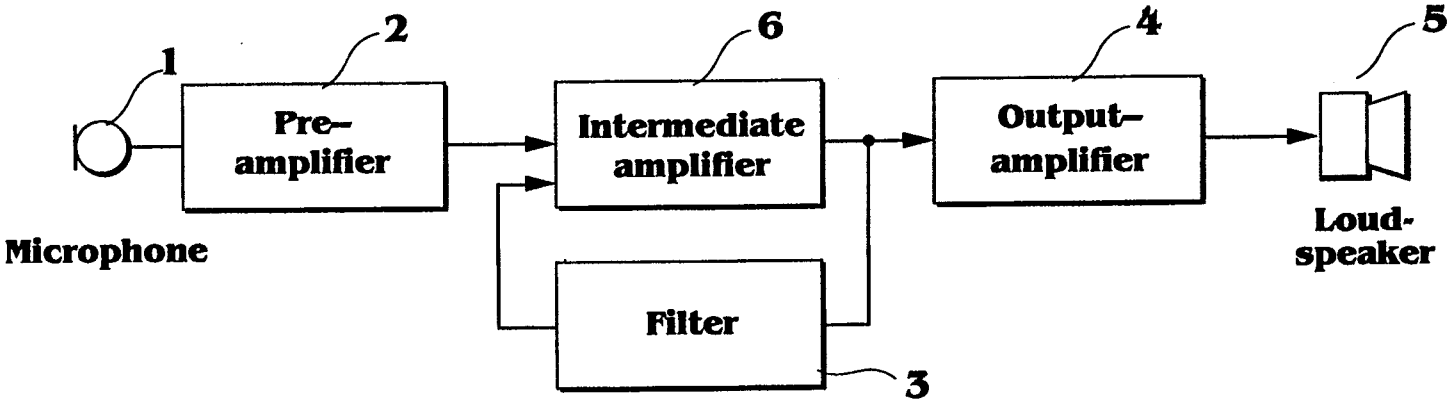
FIG. 2 shows a circuit diagram of a hearing aid in accordance with the invention, whereby the filter is arranged in the feedback loop of an amplifier.

FIG. 2 shows a circuit diagram of a hearing aid in accordance with the invention, whereby the filter is arranged in the feedback loop of an amplifier. Microphone 1 transforms the sound signal into an electrical signal which is then amplified in preamplifier 2. The signal then passes through the intermediate amplifier 6 in whose feedback loop filter 3 is arranged, which has a frequency-selective influence on the signal. Thereafter the signal is amplified in output amplifier 4 to the required output level and finally transformed by the loudspeaker 5 back to an acoustic sound signal.

Figure 3:
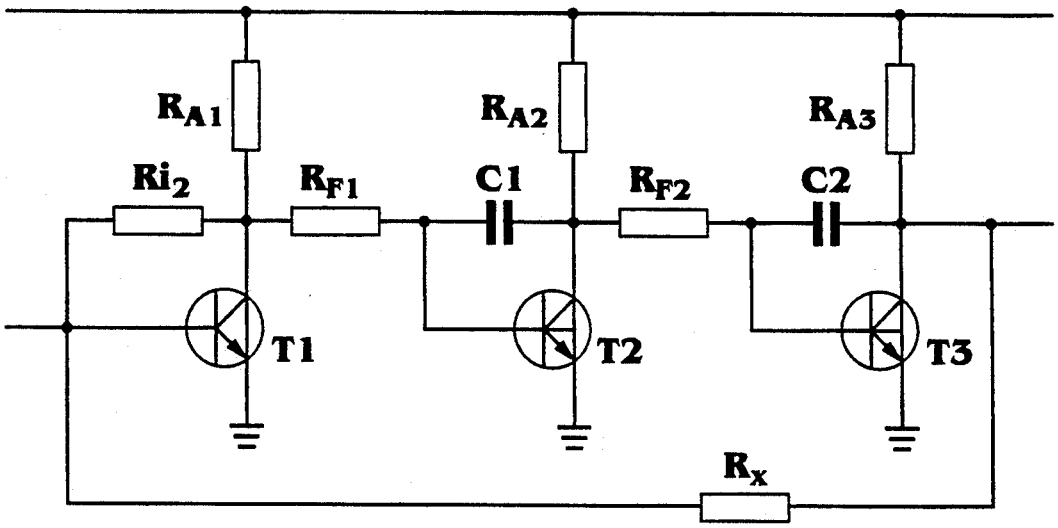
FIG. 3 shows a filter in accordance with the invention, FIG. 4 (*a, b* and *c*) shows the filter characteristics of the three outputs which are available in a filter in accordance with the invention.

FIG. 3 shows the principal arrangement of such a filter 3. Said filter has a biquadratic structure, whereby the transistors T2 and T3 in combination with resistor $R_{F1}$ and the capacitor Cl and the resistor $R_{F2}$ and the capacitor C2, respectively, form two integrators. The phase inverter stage that is required for a biquadratic structure is formed by the transistor T1 and the respective resistors $R_{F2}$, $R_X$, $R_{A1}$. The load resistors of transistors T1 to T3 are characterized by $R_{A1}$, $R_{A2}$, $R_{A3}$.

Futhermore, the collector of transistor T3 is fed back to the base of transistor T1 via the resistor $R_x$.

Figure 4A:
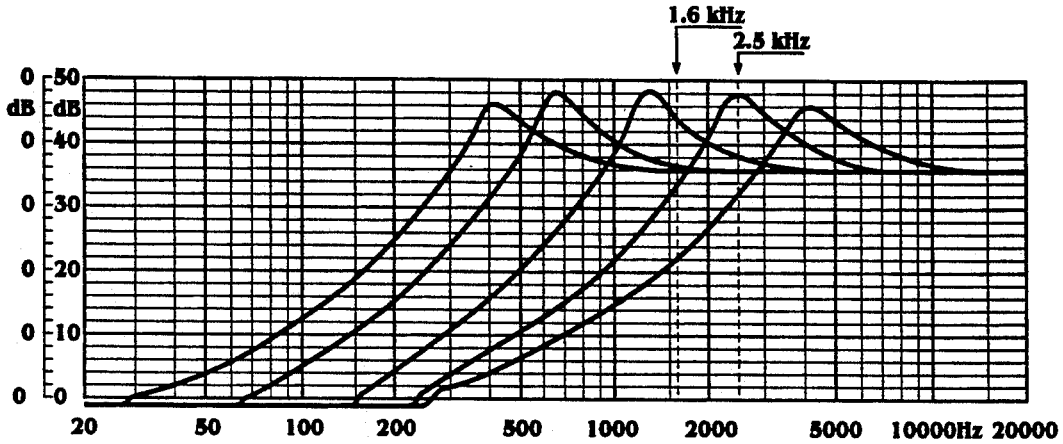
Figure 4B:
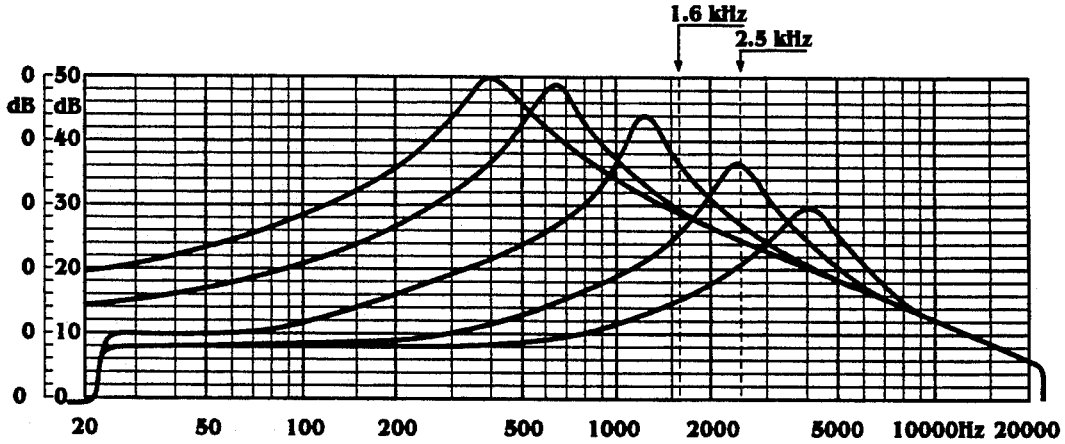
Figure 4C:
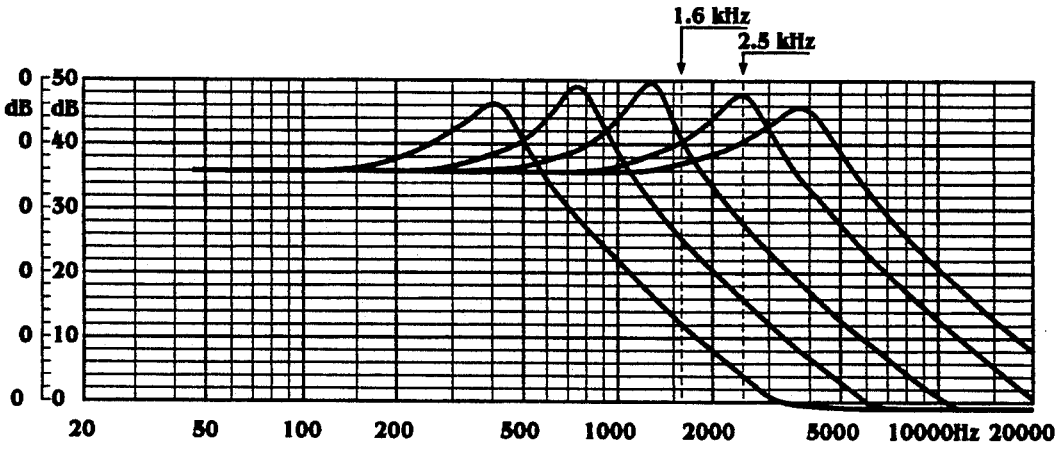

The base of transistor T1 is used in this filter as the input, whereby the collector outputs of all three transistors T1, T2, T3 are available as outputs. This leads to the fact that the collector of transistor T1 forms a highpass output (FIG. 4*a*), the collector of transistor T2 a bandpass output (FIG. 4*b*) and the collector of transistor T3 a lowpass output (FIG. 4*c*). Thus, one and the same filter can be used for various applications. The mid-frequency of this filter is determined by the resistors $R_{F1}$ and/or $R_{F2}$ and the capacitors C1 and C2.

The filter 3 as outlined in FIG. 3 concerns a simplified Kerwin-Huelsman-Newcomb structure, which belongs to the group of biquadratic filters. By providing a further feedback from the collector of transistor T2 to the emitter of transistor T1 by means of an emitter resistor it is also possible to change the quality factor of the filter and to upgrade the filter to a full Kerwin-Huelsman-Newcomb structure.

Furthermore, all three base connections can be connected to a joint input by means of three high-value resistors. In this case the collectors of the transistors T1 or T3 can be used as bandpass output. But then there is no highpass output. Such a structure is then equivalent to a Tow-Thomas structure, which also belongs to the biquadratic filters.

For a simplified bandpass the base of transistor T3 can be used as an input alone.

With the filter 3 in accordance with FIG. 3 and the mentioned alterations to said filter it is possible to arrange nearly all equalizer circuits by the respective selection of the impedances and the feedbacks.

Figure 5:
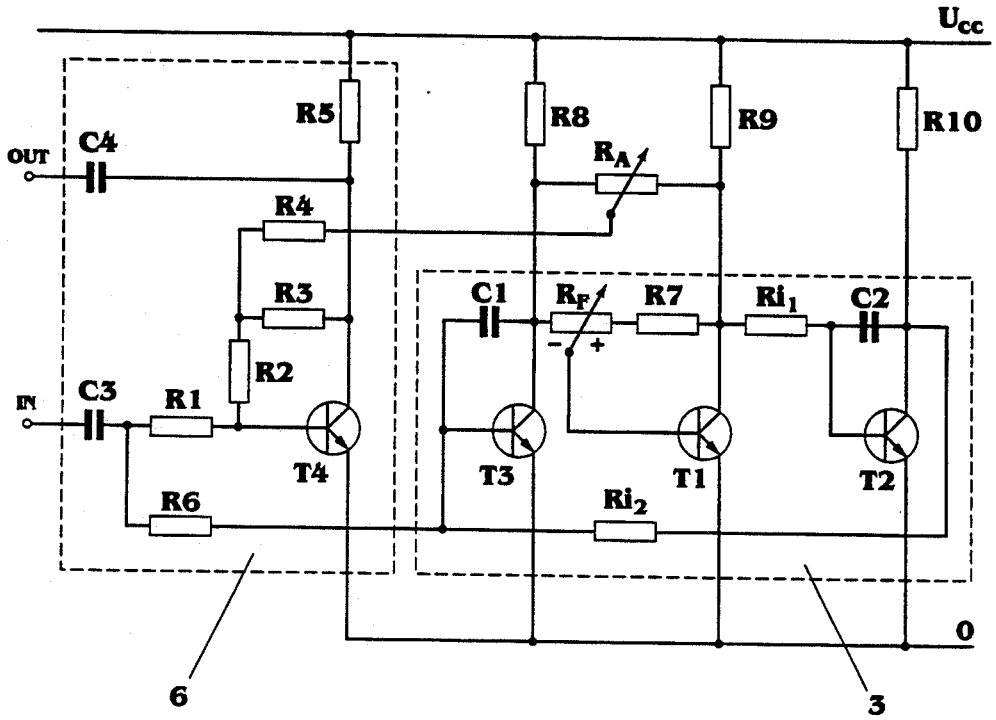
FIG. 5 shows a practical embodiment of a filter circuit.

FIG. 5 shows an example of an amplifier 6 with this filter 3. The transistor T4 with its load resistor R5 serves as an amplifier in this example, whereby a base-collector countercoupling through the resistors R2 and R3 is provided in the known manner for stabilizing the operating point and setting the amplifier.

This amplifier 6 is connected to filter 3 via resistors R4 and R6, whereby the filter is disposed in the feedback loop of the amplifier 6. Here the transistors T1 to T3 form a biquadratic structure, whereby the transistor T3 with the resistor $R_{F2}$ and the capacitor C1 as well as the transistor T2 with the capacitor C2 and the resistor $R_{F1}$ form the two integrators. The phase inverter stage is formed by the transistor T1 with the resistors $R_F$ and R7. The amplification of the amplifier T1 arranged in filter 3 can be altered by the resistor $R_F$ which is arranged as a potentiometer, whereby the change in the amplification results in a shift of the resonant frequency of the whole filter 3. The load resistors of the filter 3 are formed by resistors R8, R9 and R10.

The collector of the transistor T3 forms the bandpass output of the filter 3, whereby a signal in opposite phase thereto can be tapped on the collector of the transistor T1. The potentiometer $R_A$ has an influence on the amplitude and the phase of the signal fed back to the amplifier 6. This allows selecting the feedback of the transistor T4 in such a way that depending on the setting of the potentiometer $R_A$ a selective emphasis is achieved by a positive feedback (regenerative feedback) or a negative feedback (reverse feedback) by de-emphasizing the signal passing through filter 3. The quality of the filter 3 is substantially determined by the dimensioning of the resistors R2, R3 and R4.

A near unlimited number of filter curves can be realized in this way with only two adjustment elements. Said adjustment elements can, for example, be potentiometers that can be operated manually, trimmers, and also electrically controllable impedances, which are formed, for example, by transistors.

Figure 6:
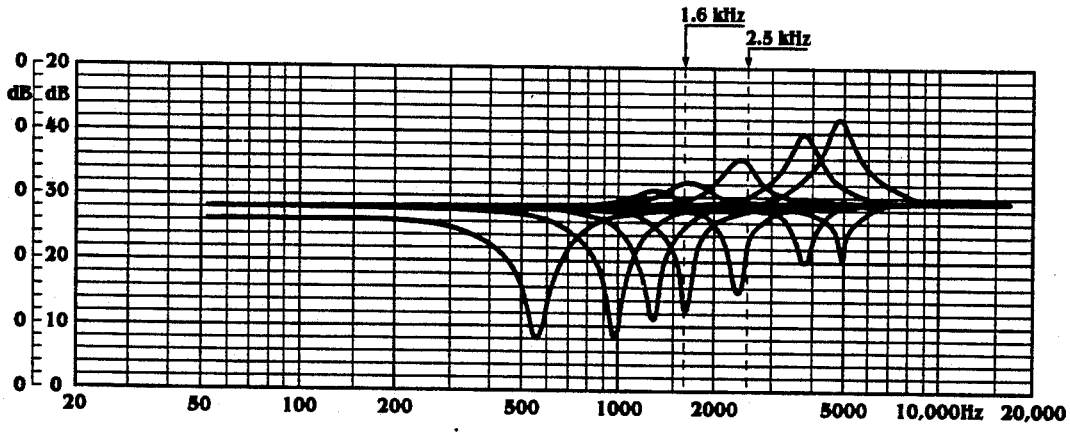
FIG. 6 shows the function of the circuit of FIG. 5 in a display of the frequency response.

FIG. 6, for example, shows the function of the circuit in accordance with FIG. 5, whereby the mid-frequency of the emphasis or the de-emphasis can be selected by adjusting the resistor $R_F$. FIG. 6 only shows a number of arbitrarily selected frequency responses, whereby the course of the curves above and below the central line indicates to which extent the emphasis and the de-emphasis of the individual frequencies can be varied.

It can be seen that towards the low frequencies the extent for adjusting the de-emphasis increases and vice-versa. This behaviour is usually beneficial for a person's hearing impairment, as they usually require a de-emphasis of the low frequencies for reducing distorting noises and a rise in the high frequencies for improving the understandability of spoken language. FIG. 6 also shows that by means of the biquadratic filter circuits provided by the invention it is possible to carry out very selective emphases and de-emphases. By combining this parametric filter with a highpass and/or a lowpass filter it possible, as was already explained above, to realize all frequency response that are required in the practice.

I claim:

1. A heating aid, comprising:

a microphone for generating an electrical signal;

one amplifier coupled to said microphone for amplifying said signal, said one amplifier having a feedback loop including a biquadratic filter for influencing the frequency response of said signal, said filter having active elements formed by discrete signal transistors, including:

i) at least two integrators; and ii) an inverting amplifier, said one amplifier being distinct from said inverting amplifier; and a loudspeaker coupled to said one amplifier for transforming said amplified and filtered signal into sound waves.

2. A hearing aid, comprising:

a microphone for generating an electrical signal;

an amplifier coupled to said microphone for amplifying said signal, said amplifier having a feedback loop including a first adjustable potentiometer for selectively setting filter emphasis and filter de-emphasis;

a higher order multiple filter coupled to said amplifier for adjusting the frequency response of said signal, said filter being biquadratic filter having a second adjustable potentiometer for setting a mid-frequency of said filter, and active elements formed by discrete single transistors including:

i) at least two integrators; and ii) an inverting amplifier; and a loudspeaker coupled to said amplifier for transforming said amplified and filtered signal into sound waves.

3. A heating aid, comprising:

a microphone for generating an electrical signal;

an amplifier coupled to said microphone for amplifying said signal, said amplifier having a feedback loop including a biquadratic filter for influencing the frequency response of said signal and a first adjustable potentiometer for selectively setting filter emphasis and filter de-emphasis, said filter having a second adjustable potentiometer for setting a mid-frequency of said filter, said filter having active elements formed by discrete signal transistors, including:

i) at least two integrators; and ii) an inverting amplifier; and a loudspeaker coupled to said amplifier for transforming said amplified and filtered signal into sound waves.

* * * * *